United States Patent [19]

Tuson

[11] 4,268,191

[45] May 19, 1981

[54] STAND-BY SERVICE STRUCTURE FOR CASUAL OFF-SHORE ATTENDANCE

[75] Inventor: Samuel Tuson, Mesnil-Le-Roi, France

[73] Assignee: Entreprise d'Equipments Mecaniques et Hydraulics, France

[21] Appl. No.: 918,688

[22] Filed: Jun. 23, 1978

[30] Foreign Application Priority Data

Jul. 1, 1977 [FR] France ..... 77 20392

[51] Int. Cl.[3] ..... B63C 11/00; B63C 11/52

[52] U.S. Cl. ..... 405/195; 405/173; 405/194; 405/202; 405/189

[58] Field of Search ..... 405/195–209, 405/169, 170, 185–189, 173, 194; 175/5–10; 166/350, 359, 367

[56] References Cited

U.S. PATENT DOCUMENTS

| | | | |
|---|---|---|---|
| 2,171,672 | 9/1939 | Plummer | 405/207 |
| 2,503,516 | 4/1950 | Shrewsbury | 405/203 X |
| 3,111,812 | 11/1963 | Clarke . | |
| 3,136,133 | 6/1964 | Perret | 405/170 |
| 3,407,612 | 10/1968 | Pearce . | |
| 3,466,880 | 9/1969 | Elliott . | |
| 3,522,709 | 8/1970 | Vilain | 405/202 |
| 3,525,388 | 8/1970 | McClintock | 175/7 X |
| 3,545,539 | 12/1970 | Manning | 405/169 X |
| 3,591,936 | 7/1971 | Van Geuns | 405/203 X |
| 3,612,176 | 10/1971 | Bauer | 166/359 |
| 3,700,048 | 10/1972 | Desmoulins . | |
| 3,785,160 | 1/1974 | Banjavich et al. | 405/170 |

FOREIGN PATENT DOCUMENTS

| | | |
|---|---|---|
| 1519891 | 2/1968 | France . |
| 2128120 | 10/1972 | France . |
| 2266791 | 10/1975 | France . |
| 1467800 | 3/1977 | United Kingdom . |

OTHER PUBLICATIONS

"World Oil", vol. 169, Jul. 1969, Huston (A. Brun, A. P. Jaffe, The CFP/BP/Westinghouse System, pp. 105–109).

*Primary Examiner*—Dennis L. Taylor

*Attorney, Agent, or Firm*—Steinberg & Raskin

[57] ABSTRACT

The invention relates in improvement in or relating to a stand-by service structure for casual off-shore attendance. The service structure comprises an emergent articulated column pivotally connected with its submerged bottom end to a base member resting on the sea-bed. Said column is fitted with a base member module such as a base member with a workshop caisson comprising at least one opening giving access to the sea-bed and adapted to be closed in fluid-tight relationship. Furthermore, said workshop caisson is adapted to directly communicate at least temporarily with the outer atmosphere at the water surface.

18 Claims, 16 Drawing Figures

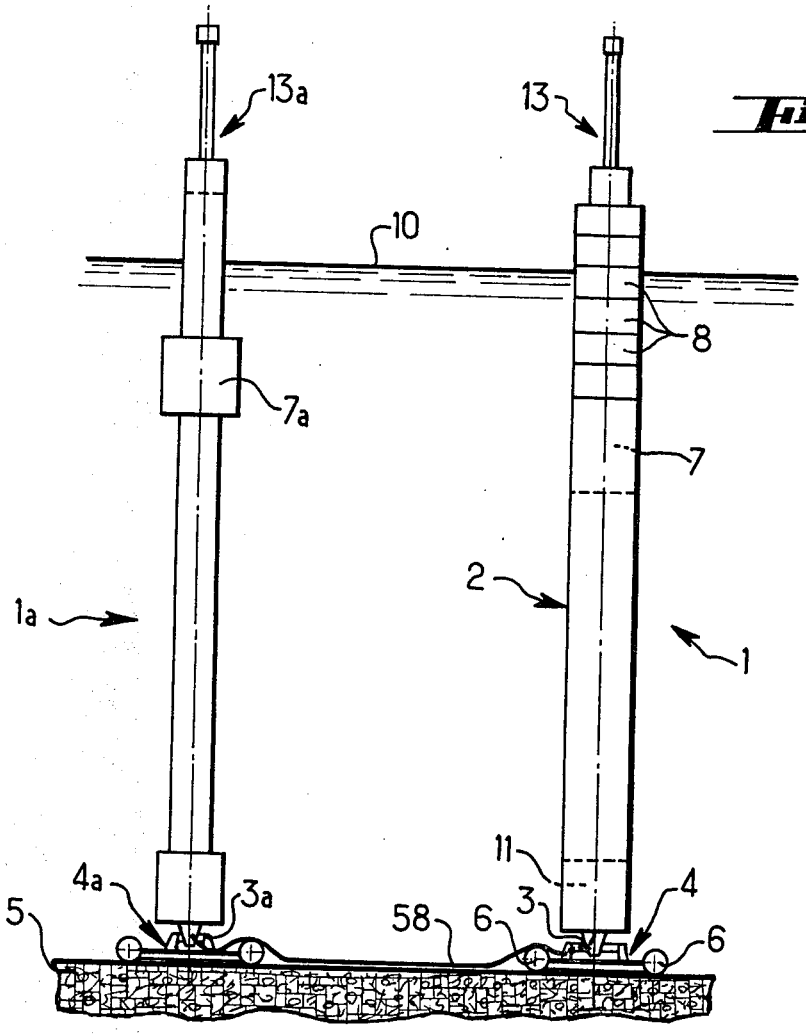
Fig: 1.
Fig: 2.
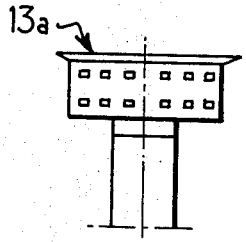
Fig: 3.
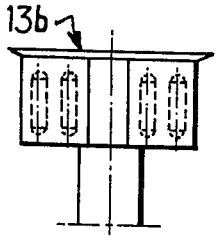
Fig: 4.
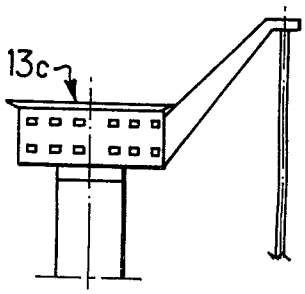

15
22
24
3
23
21
21
-16-
-4-
14
36
33
34
35
35
37
37
32
31
34
36
5
35
45
35

STAND-BY SERVICE STRUCTURE FOR CASUAL OFF-SHORE ATTENDANCE

The invention relates generally to off-shore structures, units or like devices for exploiting, working or development operations on the sea-bed and is more particularly directed to a stand-by off-shore servicing structure for casual attendance operations on the sea floor or sea bottom.

Off-shore working columns, towers or like platforms (for carrying out drilling or boring, production, separation, loading or unloading operations, etc.) installed on a sea-bed periodically require at relatively regular time intervals (for instance every five years) servicing works (such as overhaul, survey, repairs and maintenance, docking, graving, paying, careening, etc.) which may not be carried out on the spot, i.e. on the operating site so that it is periodically necessary to remove or disconnect the column from its base member resting on the sea floor and to tow it to a coast harbour or port area fitted with suitable equipment for performing such works.

During that time of being out of use, i.e. period of disabled or offduty condition of the column, the exploitation of the off-shore site of installation of the column has to be stopped or discontinued until the latter has come back thereby resulting in substantial losses through immobilization of the exploitation equipment.

Moreover, in known stand-by servicing or attendance structures, the works are accomplished in an isolated or closed-vessel condition, i.e. in a confined medium without any communication with atmospheric air. Therefore the working conditions are becoming hard for the servicing or attendant staff. Some of such structures consist of diving bells suspended through operating cables or ropes from a surface ship. Such hanging connections moreover do not enable servicing works to be accomplished under bad weather conditions without incurring cable failure or breakage hazards.

A main object of the invention is to overcome such inconveniences by providing an off-shore service structure for casual attendance on the sea-bed, of the kind comprising an emerging compliant or articulated column, tower or like platform pivotally connected with its submerged lower end to a base member resting on the sea bottom and selectively adapted either to be substituted temporarily for the normal column as an alternative facility on the off-shore site for the whole duration of the service works carried out on the latter thereby enabling the exploitation operations to be kept going on without any economically detrimental breaking off, or to perform works on the sea-bed with a servicing staff directly breathing in outside atmospheric air.

For that purpose in order to solve all of these problems, the service structure according to the invention is a multiple-purpose versatile structure the column of which includes a general purpose shaft designed or fitted up to perform several different reversible functions of transfer between the sea-bed and the water surface, said shaft being adapted to receive various interchangeable head modules having respective different functions usable separately or simultaneously in combination and/or a plurality of interchangeable base member modules with respective different specific functions.

According to another characterizing feature of the invention, the column is fitted with one or several head modules such as a flare-stack carrying head, a swivel, slewing or rotary head for loading operations, a living quarter, dwelling or staff accommodation head, a production head, power generating modules, pumping modules, well-drilling or boring modules a.s.o.

According to a further characterizing feature of the invention, the column is fitted with a base member module which may in particular be either a normal gravity base member or a base member provided with a work room or chamber for accomplishing repairs and/or connections on underwater pipe-lines or like submarine sea-lines, or a base member for handling heavy package units to be laid down or to be lifted or hoisted or to be moved along.

According to still another characterizing feature of the invention, when using a base member with a working chamber or room, the latter comprises at least one port-hole or like opening giving access to the sea-bed and adapted to be closed in fluid-tight or sealing relationship.

According to still a further characterizing feature of the invention, this work room or chamber directly communicates at least temporarily with the outer atmosphere at water surface level through the agency of the column shaft forming a ventilating duct or downcast extending substantially throughout the length or height thereof.

According to another characterizing feature of the invention, the work room or vessel consists of an elongated workshop caisson mounted underneath the base member and the bottom of which comprises an opening or hatch adapted to be closed in fluid-tight or sealing relationship and extending over the whole length thereof whereas each one of the two opposite transverse end walls of said caisson is also formed with an opening which may be closed in fluid-tight or sealing relationship and extends downward to merge into said bottom opening and comprises movable gripping members for taking hold of and insert, into the caisson, at least one part of a pipe-line section through said openings.

According to a further characterizing feature of the invention, the work room or vessel consists of a workshop caisson of a substantially semispherical shape mounted below the base member and the normally open bottom of which may be closed in fluid-tight or sealing relationship by the sea-bed itself under the action of the outside pressure exerted downwards by the water upon the caisson.

According to still a further characterizing feature of the invention, the column shaft is connected to the base member by means of a fluid-tight yielding or flexible connecting sleeve or hose angularly deformable through bending and extending through the pivotal connecting device between the column and the base member so as to form a connection which is kinematically consistent with the motions of the column.

As known per se the column is connected to the base member through a pivotal connection of the universal or Hooke's or Cardan joint coupling type and according to still a further characterizing feature of the invention, said coupling comprises a ring-shaped element arranged in substantially coaxial relationship with the column and rotatably mounted for swinging motion about two axes of rotation extending at right angles at each other and bound to the column and to the base member, respectively, the column shaft extending through the opening of the ring-shaped element.

The use of an articulated or compliant column for constituting the service structure according to the invention offers the advantage to enabling the column to be moved to the off-shore site where it has to be used, for instance at first in a substantially horizontal position and then in a substantially vertical or upright position with or without its base member.

Another advantage provided by the use of an articulated column resides in the fact that the working site of that column may be located or spotted very accurately owing to the emerging part of the column which moreover easily shows the depth, the position in the plane and the relative attitude of the base member.

According to still a further characterizing feature of the invention and advantage resulting from the use of an articulated column, the latter may be disconnected from its base member and connected again thereto later on.

The invention will be better understood and further objects, characterizing features, details and advantages thereof will appear more clearly as the following explanatory description proceeds with reference to the accompanying diagrammatic drawings given by way of non limiting examples only illustrating several presently preferred specific embodiments thereof and wherein:

FIG. 1 is a diagrammatic view in longitudinal section of a service structure according to the invention and of a conventional exploitation structure shown for illustrating a particular servicing mode;

FIGS. 2 and 4 are fragmentary views in partial longitudinal sections diagrammatically showing different head modules, respectively, which may be adapted on the column of a service structure according to the invention;

Figure 5:
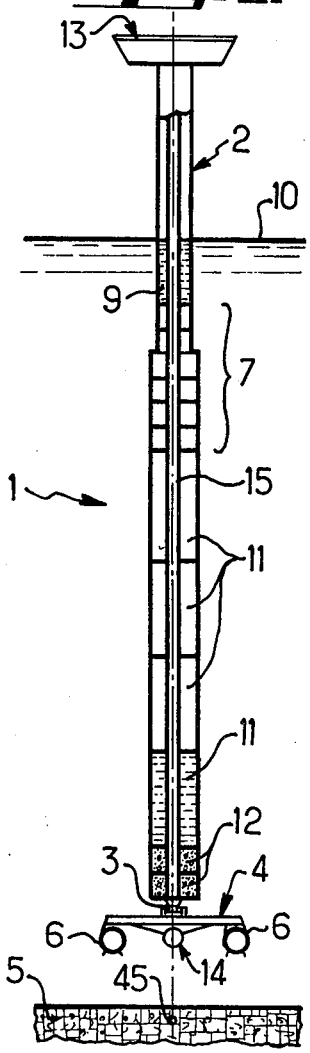
FIG. 5 is a view in axial longitudinal section of a service structure of the invention according to a particular embodiment shown in a position corresponding substantially to that of its transport condition for conveying it to the site of use.

Referring to FIG. 1, the service structure 1 consists generally of an emergent articulated column 2 pivotally connected at 3 with its bottom end to a base member 4 of conventional type adapted to rest on the sea-bed 5 and advantageously comprising ballast tanks 6. In order to provide for the stability of the column 2 during its transport and when the latter is in position on its site of use, the column is fitted with a main float or buoyancy means 7 and with a ballast float 11. Towards the upper end portion of the column 2 are provided modules 8 arranged over one another and the functions of which are depending upon the type of service to be carried out, and these modules 8 may or not be provided in the underwater portion of the column. Towards the emerged top end of the column 2 is provided a head module 13 which in the exemplary embodiment shown is a flare-stack. This head module 13 may also be a living quarter or accommodation or dwelling module **13*a* (FIG. 2), a production module 13*b* (FIG. 3), a combined dwelling and loading module 13*c* (FIG. 4), or any combination thereof. The construction 1*a* shown beside the service structure 1** according to the invention will serve the purpose of hereinafter explaining a particular servicing mode thereof.

Figure 6:
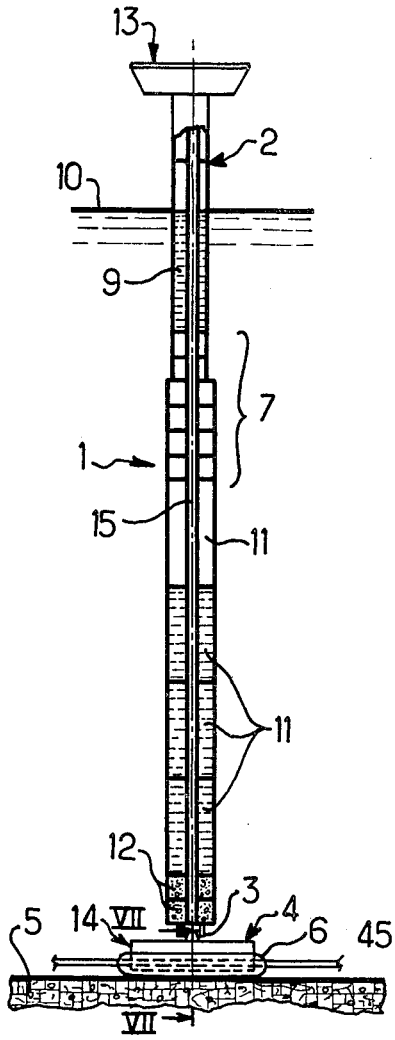
FIG. 6 is a view in longitudinal axial section of the service structure shown in FIG. 5 after the latter has been brought to bear on the sea floor.

With reference to FIGS. 5 and 6, there is shown a service structure 1 with a base member built according to a first embodiment for another kind of servicing.

This service structure 1 consists as previously of an emergent articulated column 2 pivotally connected at 3 with its lower end to a base member 4 adapted to rest on the sea bottom 5 and comprising ballast tanks 6. With a view to providing for the stability of that column during its transport and when it is in position on its site of use, the column is fitted with a main float or buoyant body 7 divided into independent casings or boxes, with a tidal rise-and-fall flow compartment 9 located above the main float and in direct communication with the water surface 10, with ballasting compartments 11 lying between the main float 7 and a concrete compartment 12 located towards the bottom end of said column. Towards the emerged top end of the column 2 is a head module 13 containing for instance the living quarters or dwelling accommodations of the service staff or operating crew or team and the machinery room generally together with a landing area, pad or like deck for helicopters or like rotary wing aircraft, provided generally at the top.

Underneath the base member 4 of the column 2 is mounted a vessel 14 forming a workshop caisson or horizontally extending elongated shape communicating directly with the atmospheric air at the water surface through a ventilating duct or downcast constituted by a hollow shaft 15 mounted preferably in coaxial relation to the column inside thereof and extending substantially over the whole height or length thereof.

Figure 7:
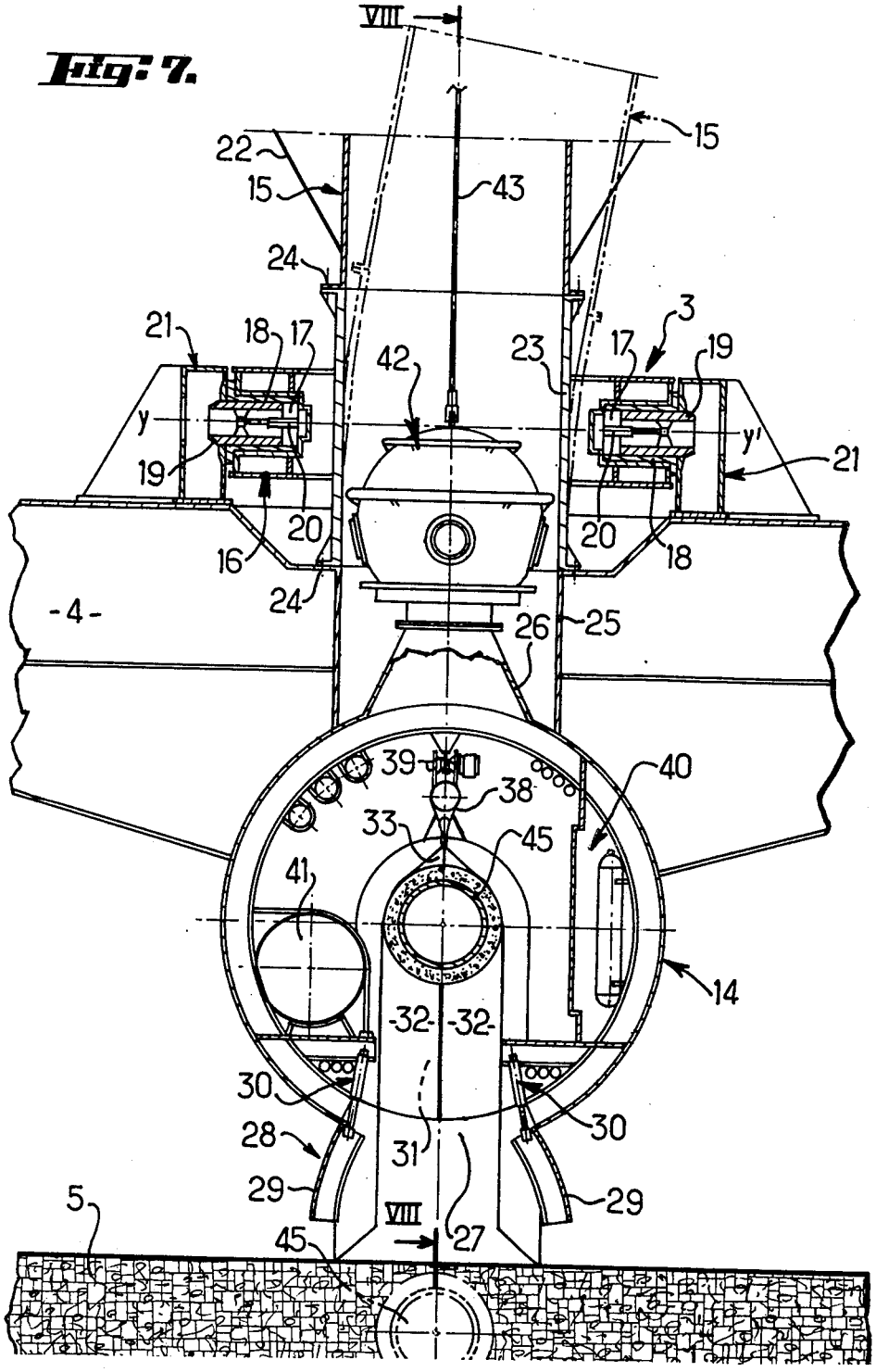
FIG. 7 is a view on a larger scale in cross-section taken upon the line VII–VII of FIG. 6, illustrating one part of the pivotal connection between the column and the base member module built according to a first embodiment.
Figure 8:
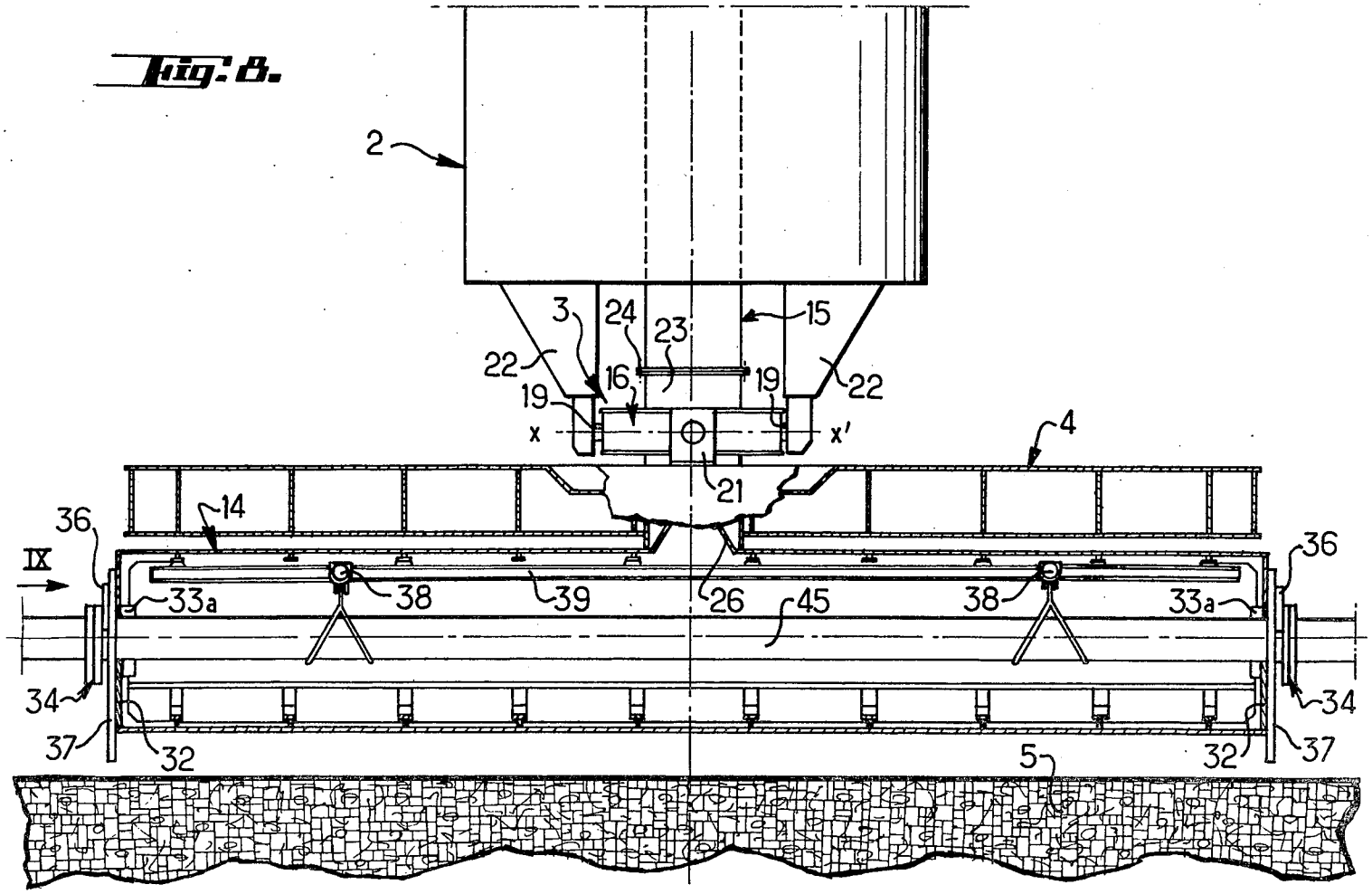
FIG. 8 is a view in cross-section taken upon the line VIII—VIII of FIG. 7 and showing another part of the pivotal connection between the column and the base member module as well as the general shape of a workshop caisson carried by said base member.

The pivotal connection 3 between the column 2 and the base member 4 as shown in FIGS. 7 and 8 is of the type forming a universal or Hooke's or Cardan joint coupling. This pivotal connection 3 comprises a ring-shaped element 16 arranged in substantially coaxial relation to the column 2 and rotatably mounted for swinging motion about two pivot axes X—X′ and Y—Y′, respectively, extending at right angles to each other and carried by the column 2 and the base member 4, respectively. The ring-shaped element 16 is formed at its outer peripheral surface with four blind radially extending recesses or passage-ways 17 forming sockets aligned in registering relationship and diametrally opposed by pairs along the axes X—X' and Y—Y', respectively. Into each socket 17 is fitted a journal bearing 18 into which is mounted a pivot pin 19. At least those two pins 19 which are aligned along the geometrical axis of rotation Y—Y' are each one movable in reciprocating translatory motion through the agency of an associated ram-like actuator or like powered operating control or jacking device 20. On the top face of the base member 4 are provided two pillar-like brackets or posts 21 forming plummer-block pillows or pedestals arranged in symmetrical relationship opposite to each other and on either side of the column and provided each one with a bore extending in coaxial relation to the geometrical axis of rotation Y—Y', these bores being adapted to receive the free ends, respectively, of the two pivot pins 19 aligned in registering relationship along the geometrical axis of rotation Y—Y' when said pins are moved radially to project outwards by their associated actuators 20.

The lower end of the column 2 is provided with two downward directed extensions or projections forming two spaced arms 22 extending in parallel symmetrical relationship on either side of the chimney-like duct 15 the bottom end of which is extended beyond the bottom end of the column 2. These arms 22 form the prongs of a fork-like clevis or yoke carrying towards the lower ends thereof, both pivot pins 19 aligned along the geometrical axis of rotation X—X'.

The movable pivot pins 19 aligned along the geometrical axis of rotation Y—Y' which may thus be retracted inwards or extended to project outwards accordingly enable the ring-shaped element 16 to be removably connected to the base member 4 which is thus selectively detachable from the column 2 by retracting said pins 19 out of the supporting brackets 21.

The chimney duct 15 is connected at its bottom end to the base member 4 by means of a fluid-tight sleeve or hose 23 which is flexible so as to be angularly deformable through bending and extends through the ring-shaped element 16 of the pivotal connection 3. This sleeve or hose is secured by means for instance of flanges 24 fastened with bolts or by means of clamping rings or fastening clamps to the duct 15 and to the base member 4, respectively.

At its bottom portion the sleeve 24 connects to a duct 25 provided in the base member 4 and which extends therethrough to communicate with the caisson 14 through a frusto-conical dome-shaped raised lock 26 provided at the top part of the caisson and projecting upwards into the duct 25.

The caisson 14 of elongated shape is formed with a bottom opening extending throughout its length and which may be closed in a fluid-tight or sealing relationship by a flap door 28 consisting for instance of a pair of oppositely located flap shutters 29 hingedly connected to the caisson so as to be movable to their closed mutually meeting position and operated by ram-like actuators or like powered jacking devices 30. Each transverse end wall of the caisson is formed with a substantially inverted U-shaped opening 33 merging downwards into the bottom opening 27 and which may be closed in part in fluid-tight or sealing relationship by means of two movable pivoting or slide shutters or door members 32 operated by means of control actuators (not shown). These door members or shutters 32 have such a shape that in their closing positions they reduce each end opening 31 to an orifice 33 corresponding to the diameter of the pipe-line to be repaired and enabling a section of such a pipe-line to pass therethrough. A sealing device **33*a* is arranged about the orifice 33 of each end opening 31 to provide for fluid-tightness between the caisson 14** and the pipe-line section.

Figure 9:
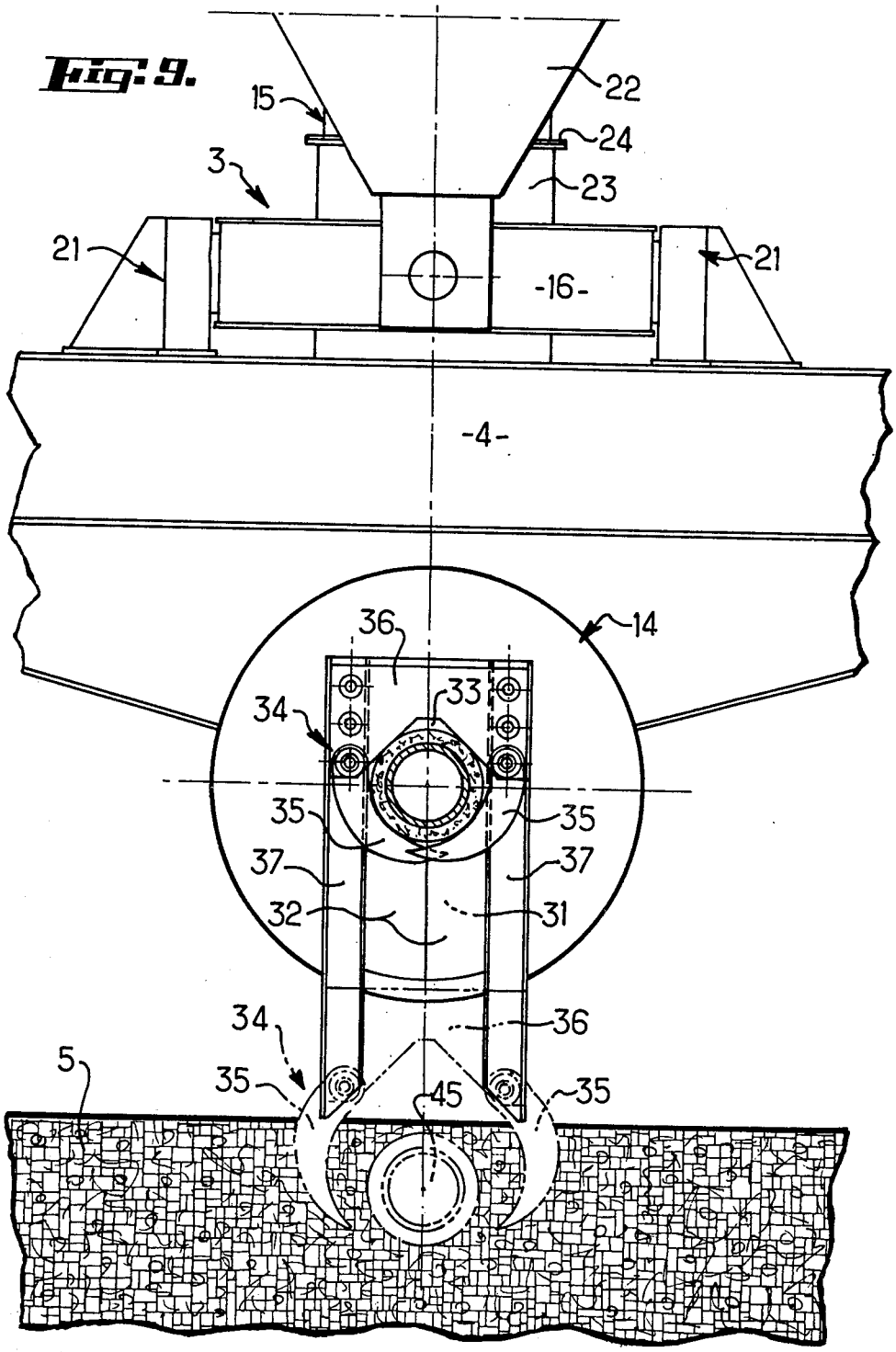
FIG. 9 is a view seen in the direction of the arrow IX of FIG. 8 to show the gripping members associated with the workshop caisson.

Referring to FIG. 9 there is provided at each end opening 31 of the caisson 14 and outside the latter a gripping device 34 such as tongs both prongs or claws 35 of which are pivotally connected to a slide-block 36 movable along two vertical guiding slideways 37 carried by the caisson and projecting downwards therefrom.

Referring again to FIGS. 7 and 8, a working equipment is provided inside the workshop caisson 14 and in particular comprises at least one hoisting gear or lift tackle 38 movable along a horizontally extending longitudinal guide rail or runway 39 co-extensive with the bottom opening 27 of the caisson, fluid-tight cupboards, chests or cabinets 40 containing servicing equipment and at least one spare section 41 for a pipe-line.

Entrance into the caisson 14 is through the duct 15 by means of a diving bell 42 suspended fom a lifting cable 43 and connectable with the dome 26. With this bell 42 it is also possible to quickly evacuate the service team in case of emergency or trouble such as an accidental flooding of the workshop caisson 14 with water or inrush of water.

Figure 10:
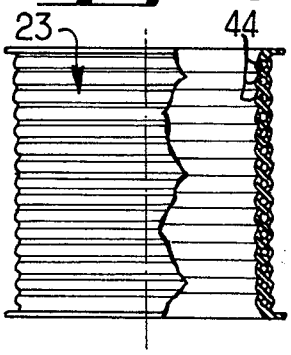
FIGS. 10 to 12 are elevational views with parts broken away, showing three alternative embodiments of the connecting sleeve or hose to be arranged between the column shaft and the base member.
Figure 11:
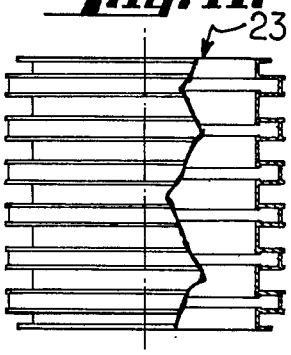
Figure 12:
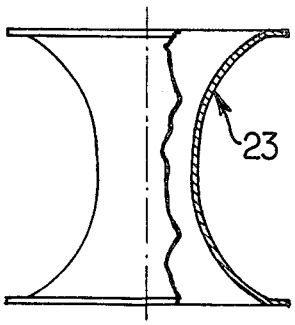

In FIGS. 10 to 12 are shown three kinds of connecting sleeves or hoses 23 usable between the chimney duct 15 and the base member 14. The sleeve 23 may consist according to FIG. 10 of an elastomeric or resilient material such as neoprene and be provided with circumferentially juxtaposed inflatable cells 44. A certain pressure built up within these cells 44 would compensate for the outer pressure due to the deep water. According to another alternative embodiment shown in FIG. 11, the sleeve 23 may be a corrugated or rippled metal sleeve. According to another modification shown in FIG. 12, the sleeve 23 is made from a reinforced flexible cloth or fabric which has such a shape that it only undergoes inner tensile stresses and that its shape in its working condition in any relative position of the column corresponds to the configuration of equilibrium or balance between the inner stresses and the outer pressure forces exerted by the water. The sleeve may also consist of a corrugated or rippled bellows preferably made from a metal material or from a reinforced elastomeric material.

Referring to FIGS. 13 to 16 there is shown a service structure with a base member module supporting a working vessel 50 forming a workshop caisson built according to a second embodiment, the pivotal connection between the column 2 and the base member module 4 being the same as that previously described. The workshop caisson 50 is of a substantially semispherical shape and is provided at its top part with a raised frusto-conical dome-shaped lock 26 for communicating with the chimney duct 15 through the connecting sleeve 23. This workshop caisson 50 exhibits the peculiarity of being devoid of any bottom wall. It is nevertheless necessary to provide a bottom wall to enable the service team or staff to work in a dry condition while communicating with the atmospheric air. This bottom wall is advantageously constituted by the sea floor or bed proper 5 once the base member 4 has been positioned onto said sea-bed. For this purpose the size of the caisson is such that once the base member has been positioned in its bottom-sitting condition the free bottom end surfaces 51 of the caisson forming a kind of dagger-like projections or dagger skirt are driven into the top soil of the sea-bed by the weight of the structure far or deep enough to provide for a good fluid-tightness and at the same time allowing the structure to withstand movement due to the scouring effects of underwater currents. The workshop caisson 50 is provided with an equipment including in particular a floor 52 provided at the lower part of the caisson and extending all about thereof with a view for instance to supporting a servicing bridge or like gangway extending across the caisson. This type of caisson is particularly advantageous in the case of a repair to be carried out onto an anchoring pile 56 partially driven into the sea-bed.

Figure 16:
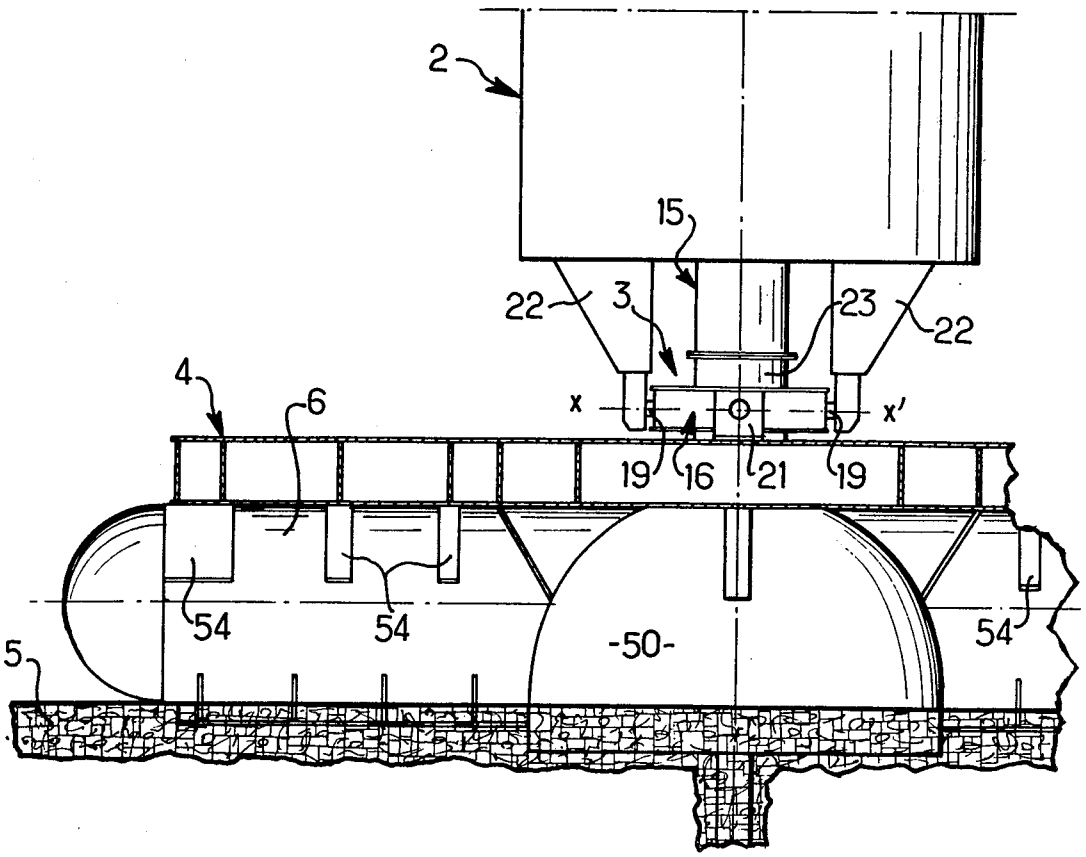
FIG. 16 is a sectional view taken upon the line XVI—XVI of FIG. 15.
Figure 13:
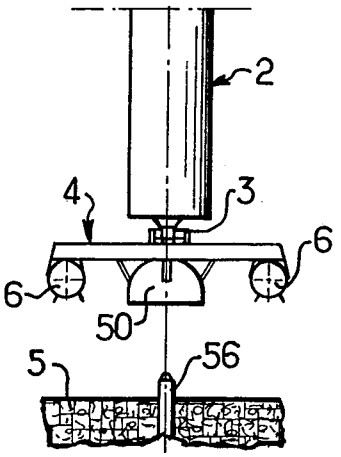
FIG. 13 is a fragmentary view in partial longitudinal section of a service structure together with a base member module built according to a second embodiment.
Figure 14:
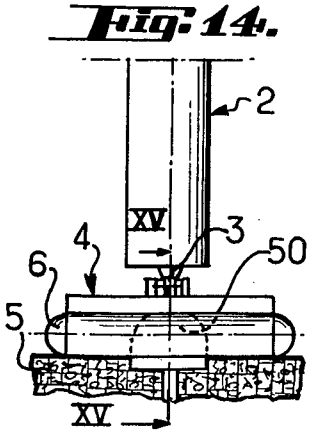
FIG. 14 is a fragmentary view in partial longitudinal section of the service structure shown in FIG. 13 after the latter has been caused to bear on the sea-bed.
Figure 15:
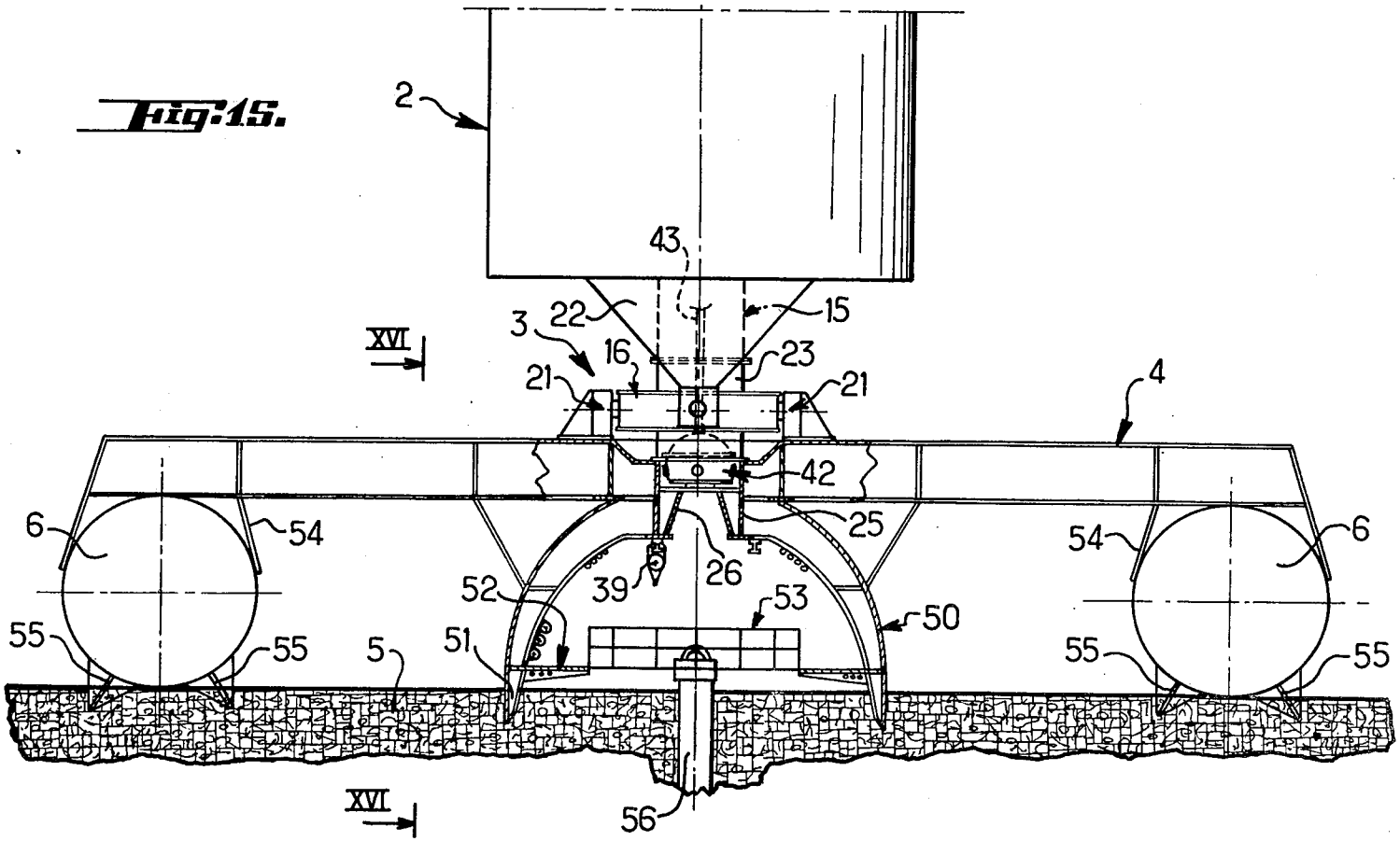
FIG. 15 is a sectional view taken upon the line XV—XV of FIG. 14.

It should also be pointed out with reference to FIGS. 15 and 16 that the ballast tanks 6 of the base member module 4 consist of a pair of tanks of elongated shapes extending in parallel relation to each other and located towards both opposite ends of the base member module 4. These tanks 6 are connected towards their upper portions to the base member module 4 by means of fastening or holding lugs 54 distributed substantially along said tanks. Such ballast tanks 6 advantageously are resting or bottom-sitting on the sea-bed 5 with their feet 55. The service column is operated in the following manner.

Referring to FIG. 1 a first type of service work may consist in temporarily replacing the functions of an off-shore exploiting structure which has to be removed from its exploitation site for undergoing repairs. The service structure or service substitute structure is towed to the off-shore site of use thereof in a horizontal position for instance. Then several approaches may be contemplated:

the service structure is sunk so as to cause it to rest or seat in a vertical position on the sea-bed near or close to the exploitation structure 1*a*. Then the connections 58 required for keeping exploiting the off-shore site are made between the base member 4 of the service structure 2 and the base member 4*a* of the exploitation structure 1*a*. Afterwards the exploitation column 1*a* is disconnected from its base member 4*a* to be towed off to a coast harbour or port area with a view to effecting the required repairs:

as the service structure 1 has to be connected to the base member 4*a* of the exploitation structure 1*a* to be replaced, the latter is at first disconnected from its base member 4*a* and then the service structure 1 which has been towed to the site without any base member is sunk for being connected to the base member 3*a*.

According to the type of the exploitation structure 1*a* which has to be serviced the service structure 1 is suitably fitted out in order to be capable of accomplishing either the same functions as the exploitation structure 1*a* or servicing or work-over operations on the well head which is being exploited. The shaft 15 of the column 2 of the service structure is accordingly adapted to receive:

on the one hand different interchangeable head modules such as a flare-stack carrying head, a swivelling, slewing or rotary head for loading purposes, a production head, power generating modules, pumping modules, separation modules, mud injection modules, well cementing modules (manufacture of the cement and injection thereof), well-drilling modules. Such modules are adaptable separately or in combination at the top of the shaft and/or inside thereof. Moreover to perform the various reversible functions of transfer between the sea bottom and the surface, the shaft may be fitted with pipe-lines for establishing either a high pressure (350 bars), crude oil circuit or an oil circuit for tanker ship loading purposes or for transfer into a tank (under a pressure of 35 bars), or a gas circuit (at a pressure of 10 to 30 bars), or an injection water circuit and/or a high pressure (from 70 to 350 bars) injection gas circuit, or with electrical feed lines arranged in electric circuitry to supply power to the service structure or to an exploitation structure:

and on the other hand a base member module which may be either a normal gravity base member or a base member with a workshop caisson for carrying out repairs and/or connections on sections of a submarine or underwater pipe-line, or a base member for handling heavy package units for immediate or delayed use.

In the case where the servicing operation to be carried out consists in repairs in particular to be accomplished on a section of an underwater pipe-line resting on the sea-bed or in an excavation thereof, the service structure is advantageously fitted with a base member supporting a workshop caisson such as the one shown in FIGS. 7 to 9.

Assuming that a repair or a connection has to be carried out on a section 45 of a submarine pipe-line, the service structure 1 is then towed to its site of use. Then the opening of the flap doors 29, 32 of the workshop caisson 14 is controlled and operated by their associated actuators for letting water flowing into the workshop caisson 14 and into the chimney duct 15. Then by suitably ballasting the ballast compartments 11, the column 2 is sunk to bear or seat onto the sea-bed 5 through its base member 4.

The gripping members 34 are then operated to take hold of the pipe-line section 45. Then the same gripping members 34 are raised or moved upwards along the slideways 37 so as to insert the pipe-line section 45 into the workshop caisson 14 through the openings 27 and 31. The latter are afterwards closed in fluid-tight relationship by the flap doors 29 and 32 together with the sealing devices 33*a* being positioned at the opposite transverse end walls of the workshop caisson for closing the orifices 33 thereof in sealing relationship, through which the pipe-line section 45 extends. Then the water present in the caisson 14 and in the duct 15 is removed by suitable pumping means.

The operating team or staff may then be lowered or moved down by means of the diving bell 42 into the caisson 14 for carrying out the necessary works on the pipe-line section 45, one of the first operating steps consisting in lifting and holding the pipe-line section 45 inside the caisson by means of the hoisting gears 38.

Then in order to put the pipe-line section 45 back to its normal working position after having carried out all works thereon, the same operations are performed but in their reverse sequential order. During the servicing period and without interfering with the work of the servicing team or staff operating in the workshop caisson the column may swing or oscillate under the action of the surge or swell and of the wind owing to the provision of the flexible sleeve 23 between the chimney duct and the base member. The greatest admissible inclination of the column is for instance of $\pm 10°$.

All the operating steps relating to the positioning of the pipe-line section 45 inside of the workshop caisson 14 and to its moving out of said caisson subsequent to the repair work are remote-controlled from the water surface.

When the service work has to be performed on an anchoring pile 56 partially driven into the sea-bed it is possible to advantageously use a workshop caisson such as the one shown on FIGS. 15 and 16. The service structure is moved to its off-shore site of use and then sunk down to rest onto the sea-bed, the caisson 50 and the chimney duct 15 being then filled with water. Then this water is removed therefrom by suitable pumping means thereby resulting in a firmer anchoring of the workshop caisson 50 by being driven deeper into the sea-bed 5 under the action of the outer pressure exerted by the water upon the caisson. Thus once the water has been removed the caisson 50 is quite fluid-tight. The operating staff or team may then be lowered by means of the diving bell 42 into the caisson 50 with a view to carrying out the necessary works on the anchoring pile 56.

Such a service structure may also serve for the transport and positioning on a precise spot which may be easily located at the water surface, of heavy loads to be laid down onto the sea bottom such as moorings for anchoring purposes, pipe connecting blocks or fittings, etc. Such loads are then hung under the base member and automatically released or dropped through remote control from the water surface.

It should be understood that the invention is not at all limited to the embodiments which have been described and shown herein by way of illustrative examples only but that it comprises all the technical equivalents of the means described as well as their combinations if same are carried out according to its gist and used within the scope of the appended claims.

What is claimed is:

1. A service structure for attendance work on the sea-bed, of the type comprising an emergent articulated column having an emergent upper portion, said column being pivotally connected through a connecting device at its submerged bottom end to a base member resting on said sea-bed; said column including a hollow shaft extending between the emergent portion and base member of the column to constitute means for accomplishing transfer functions between the sea-bed and the water surface; said base members being provided with a workshop caisson for allowing work to be performed on sections of an underwater pipeline resting on the sea-bed or within an excavation thereof, said workshop caisson including at least one bottom opening providing access to the sea-bed and means for sealing said caisson in fluid-tight relationship so that it directly communicates at least temporarily with the outer atmosphere at the water surface through said hollow shaft which forms a ventilating duct; wherein said workshop caisson is of a substantially elongated shape and includes a bottom in which said bottom opening is formed, means extending over substantially the entire length of said bottom for sealingly closing said bottom opening, two transverse opposed end walls, each of which is formed with an opening which merges downwardly into the bottom opening, means for sealingly closing said end wall openings, said workshop caisson further comprising movable gripping members for gripping and inserting into the caisson through said bottom and end wall openings at least one portion of a pipe-line section.

2. A service structure according to claim 1, wherein said workshop caisson comprises two of said gripping members located at both transverse opposite end walls, respectively, of the caisson and outside thereof, each gripping member comprising tong means which are pivotally connected to a slide-block which is mounted for movement along two substantially vertically extending guiding slideways supported by said caisson and projecting downwardly therefrom.

3. A service structure according to claim 2, wherein said workshop caisson further includes apparatus comprising an emergency breakdown pipe-line section, fluid-tight cupboards, chests or like cabinets and at least one hoisting gear for lifting that part of the pipe-line section which has been inserted into said caisson.

4. A service structure according to claim 1, wherein said column shaft is connected to said base member by means of a flexible fluid-tight connecting sleeve which is angularly deformable, said sleeve extending through said pivotal connecting device connecting said column and said base member so as to form a connection kinematically consistent with the motions of said column.

5. A service structure according to claim 4, wherein said sleeve is formed of an elastomeric or resilient material such as neoprene, formed with inflatable cells.

6. A service structure according to claim 4, wherein said sleeve is a corrugated or rippled metal sleeve.

7. A service structure according to claim 4, wherein said sleeve is a yielding sleeve made from a reinforced cloth or fabric which has a shape such that the sleeve only undergoes inner tensile stresses and that its shape in its operating or working condition corresponds to the configuration of equilibrium between the inner stresses and the outer pressure forces exerted by the water.

8. A service structure according to claim 5, wherein said sleeve is connected to a duct provided in said base member and which extends therethrough to communicate with said workshop caisson through a substantially frusto-conical dome-shaped raised lock provided at the top part of said caisson and projecting upwards into said duct.

9. A service structure according to claim 8, wherein said duct comprises an entrance passage into the caisson from within said column through means such as a diving bell suspended from a lifting cable and connectable to said dome-shaped lock.

10. A service structure according to claim 9, wherein said column is connected to said base member through a pivotal connection of the type forming a universal or Hooke's or Cardan joint coupling, characterized in that said joint coupling comprises a ring-shaped element arranged in substantially coaxial relation to said column and rotatably mounted for swinging motion about two perpendicular axes of rotation carried by said column and said base member, respectively, the hollow shaft of said column extending through the opening of said ring shaped element.

11. A service structure according to claim 10, wherein said ring-shaped element is provided on its outer peripheral surface with four radially extending blind passage-ways forming sockets aligned in registering relationship, respectively, and diametrically opposed by pairs along both geometrical axes of rotation, respectively, and in that a journal bearing, into which is mounted a pivot pin, is fitted in each such socket.

12. A service structure according to claim 11, wherein both pivot pins associated with said base member are axially movable in a reciprocating translatory motion by means of a powered actuator associated with each pivot pin thereby enabling said base member to be selectively disonnected from said column by retracting said pivot pins radially inwards.

13. A service structure for attendance work on the sea-bed, of the type comprising a base member resting on the sea-bed and provided with a workshop caisson for allowing work to be performed on the sea-bed, wherein said workshop caisson is of a substantially semispherical shape having a normally open bottom, the latter being closable in fluid-tight relationship by the sea-bed itself by having its free bottom end surfaces driven into said sea-bed, and wherein said workshop caisson is connected to a base member of an emergent articulated column, said caisson being fluidly coupleable with a hollow shaft provided on said column so as to communicate at least temporarily with the outer atmosphere at the water surface whereby various functions of transfer between the sea-bed and the water surface can be accomplished, and wherein said column shaft is connected to said base member by means of a flexible, fluid-tight and yielding connecting sleeve formed of reinforced cloth, or fabric, said sleeve being angularly deformable and having a shape such that it only undergoes inner tensile stresses, said sleeve extending through a pivotal connecting device connecting said column and said base member so as to form a connection kinematically consistent with the motions of said column such that the shape of the sleeve in its operating or working condition corresponds to the configuration of equilibrium between the inner stresses and the outer pressure forces exerted by the water.

14. A service structure according to claim 13, wherein said sleeve is connected to a duct provided in said base member and which extends therethrough to communicate with said workshop caisson through a substantially frusto-conical dome-shaped raised lock provided at the top part of said caisson and projecting upwards into said duct.

15. A service structure according to claim 14, wherein the said duct comprises an entrance passage into the caisson from within said column through means such as a diving bell suspended from a lifting cable and connectable to said dome-shaped lock.

16. A service structure according to claim 15, wherein said column is connected to said base member through a pivotal connection of the type forming a universal or Hooke's or Cardan joint coupling, characterized in that said joint coupling comprises a ring-shaped element arranged in substantially coaxial relation to said column and rotatably mounted for swinging motion about two perpendicular axes of rotation carried by said column and said base member, respectively, the hollow shaft of said column extending through the opening of said ring shaped element.

17. A service structure according to claim 16, wherein said ring-shaped element is provided on its outer peripheral surface with four radially extending blind passage-ways forming sockets aligned in registering relationship, respectively, and geometrically opposed by pairs along both geometrical axes of rotation, respectively, and in that a journal bearing, into which is mounted a pivot pin, is fitted in each such socket.

18. A service structure according to claim 17, wherein both pivot pins associated with said base member are axially movable in a reciprocating translatory motion by means of a powered actuator associated with each pivot pin thereby enabling said base member to be selectively disconnected from said column by retracting said pivot pins radially inwards.

* * * * *